United States Patent [19]

Warshawsky

[11] 4,449,172

[45] May 15, 1984

[54] LAMP SWING UNITS

[76] Inventor: Jerome Warshawsky, 3284 Bertha Dr., Baldwin Harbor, N.Y. 11510

[21] Appl. No.: 434,545

[22] Filed: Oct. 15, 1982

[51] Int. Cl.[3] ..... F21M 3/18

[52] U.S. Cl. ..... 362/427; 362/418; 362/419; 362/432; 362/285; 248/284

[58] Field of Search ..... 362/431, 432, 413, 417, 362/427, 418, 419, 285; 248/284

[56] References Cited

U.S. PATENT DOCUMENTS

| | | | |
|---|---|---|---|
| 2,280,402 | 4/1942 | Greppin | 362/432 |
| 2,488,898 | 11/1949 | Brasty | 362/413 |
| 3,983,386 | 9/1976 | Kammer | 240/81 R |
| 4,247,886 | 1/1981 | Warshawsky | 362/427 |
| 4,347,557 | 8/1982 | Warshawsky | 362/427 |

*Primary Examiner*—Stephen J. Lechert, Jr.
*Assistant Examiner*—Howard J. Locker
*Attorney, Agent, or Firm*—Stephen E. Feldman

[57] ABSTRACT

The swing unit, for mounting the swing arm assembly of a swing arm lamp, is formed as a relatively short substantially tubular member having a tubular mounting end of reduced outside diameter and that is provided with a circumferential groove. The reduced end of the swing unit is received by the mounting seat of a support unit which mounts same for rotation about a predetermined axis of rotation. A threaded bolt like member is carried by the support unit so that an end of the threaded member can be moved from a position with its end projecting into the groove, to prevent unseating of the swing unit from the support, but not so as to prevent rotation thereon; to a position with its end removed from the groove so that the swing unit can be removed from the support. The swing unit receives an end of a tubular swing arm of the swing arm assembly along a line which is either perpendicular to said predetermined axis of rotation or co-axial therewith. The support for the swing unit is either plate like for mounting to a wall, or substantially tubular to facilitate mounting the swing arm to a base mounted support post for a table or floor lamp. The support mounts either a single swing unit for a single swing arm assembly; or a pair of co-axial swing units for a pair of co-planar swing arms of either straight or bowed configuration.

21 Claims, 10 Drawing Figures

FIG. 1
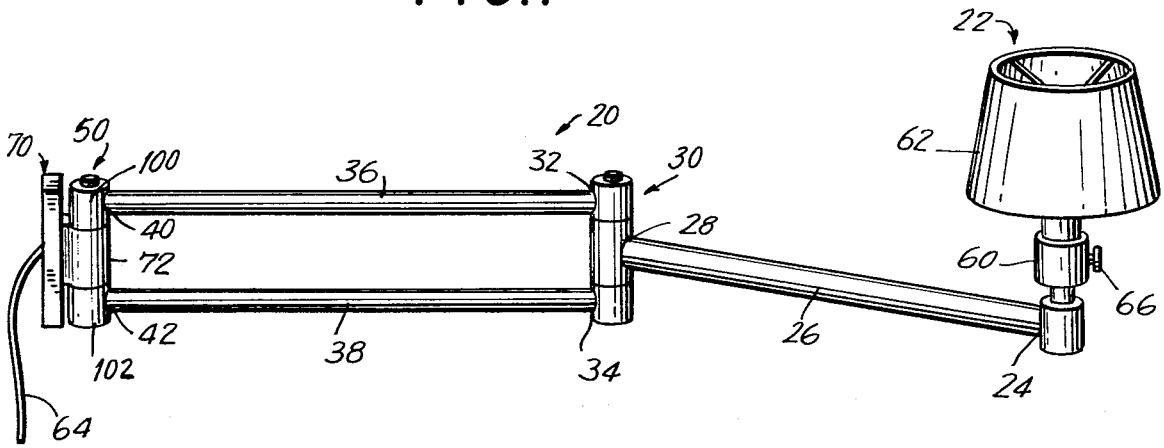
FIG. 2
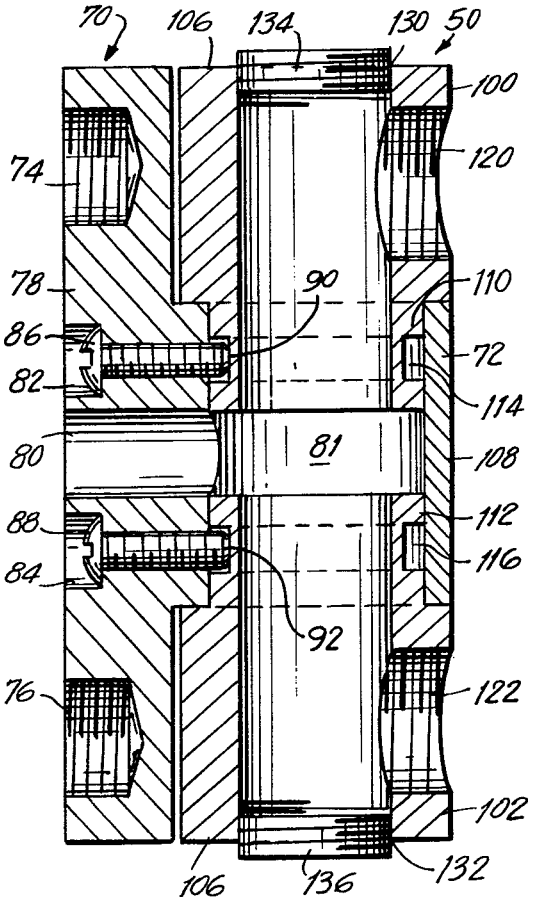
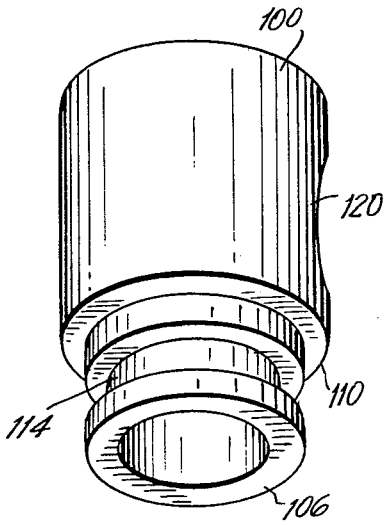
FIG. 3

FIG. 4
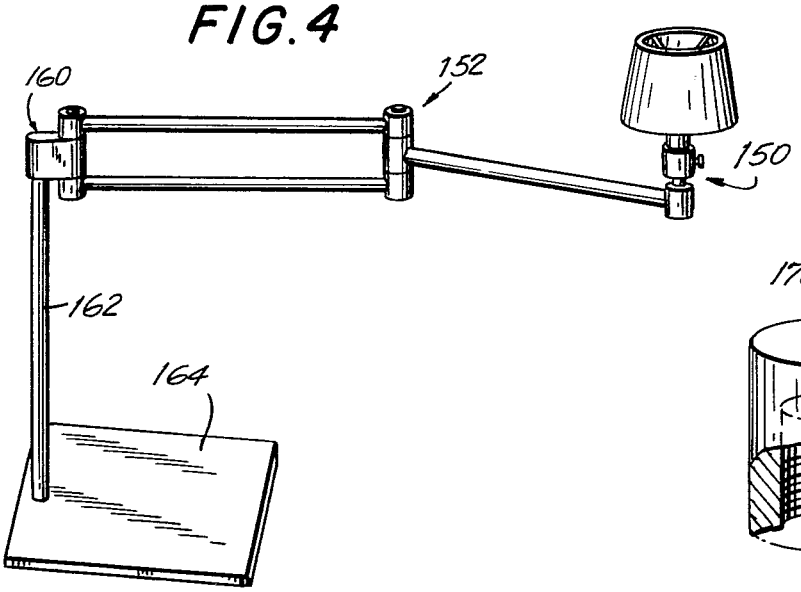
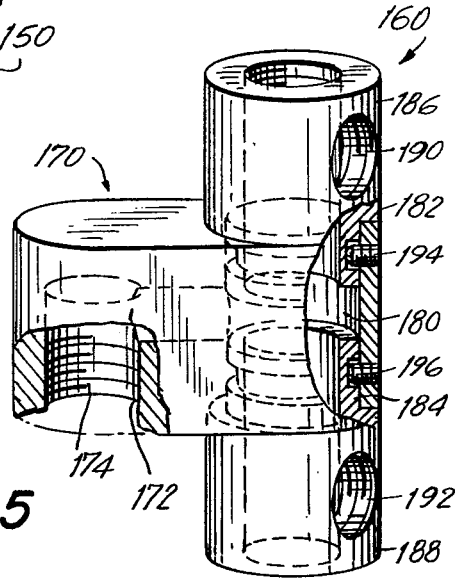
FIG. 5
FIG. 6
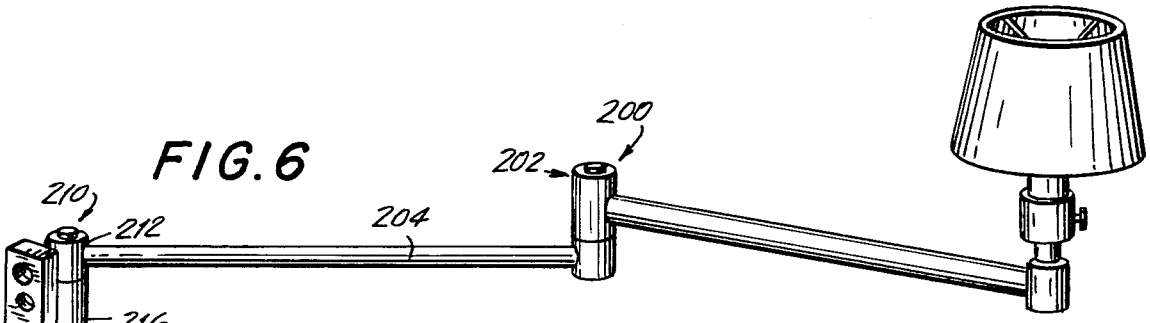
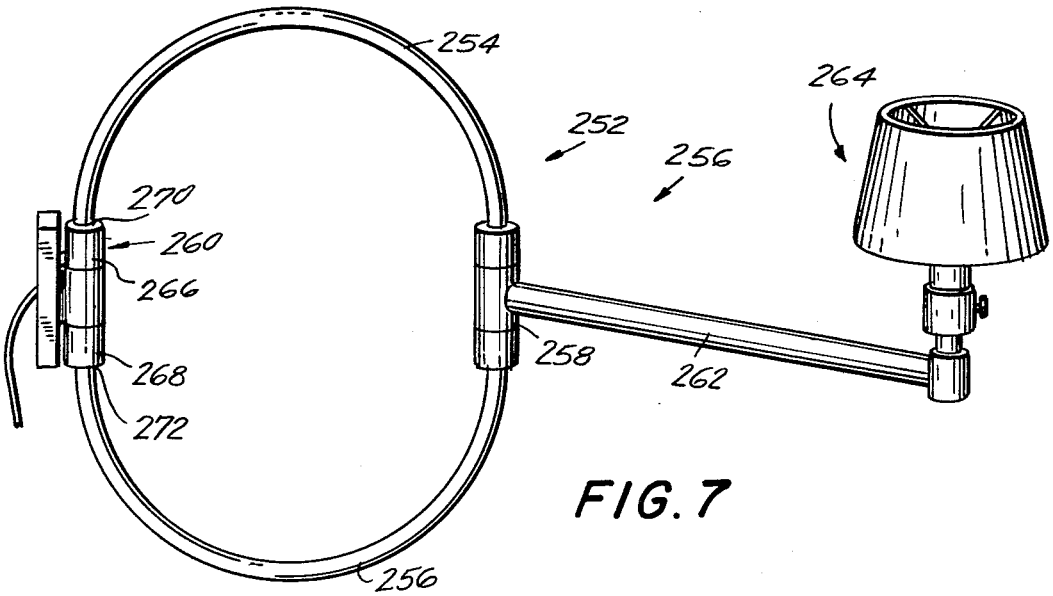
FIG. 7

FIG. 8
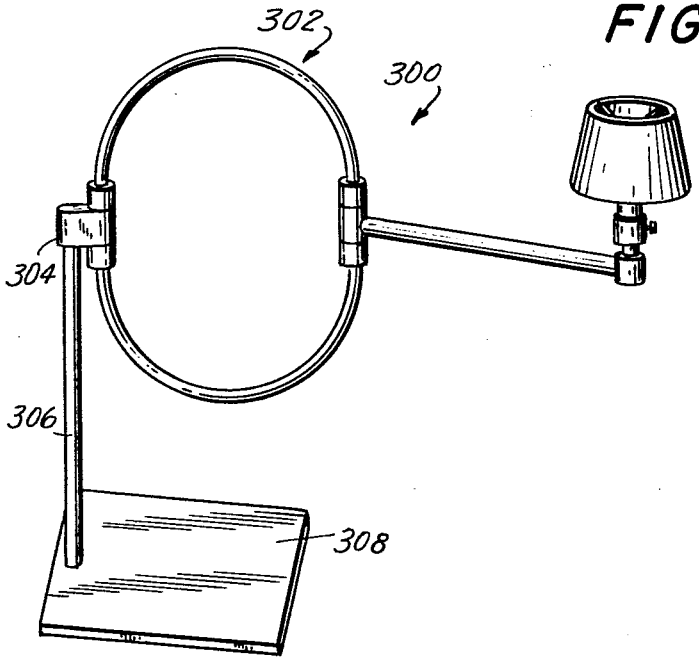
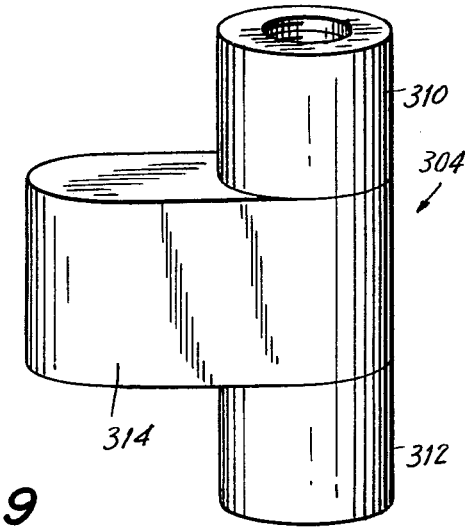
FIG. 9
FIG. 10
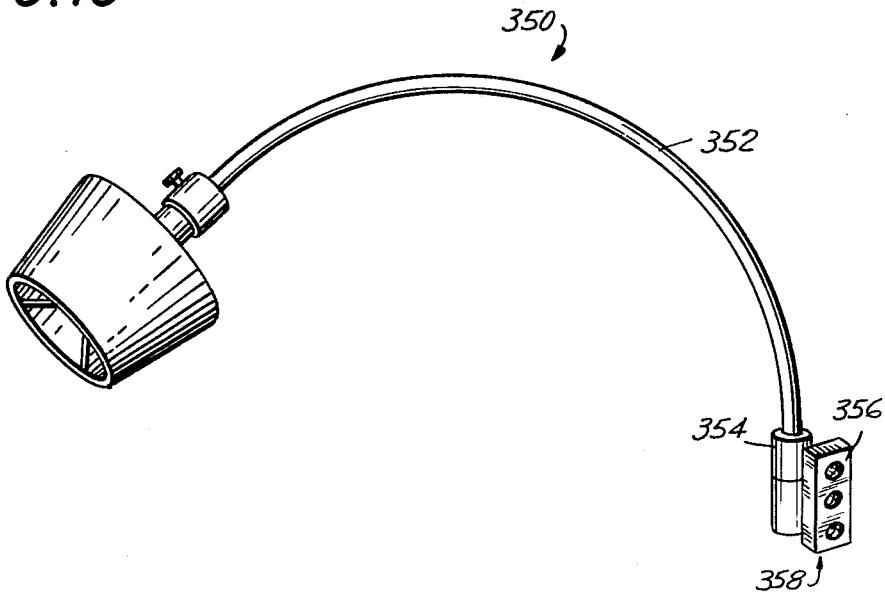

LAMP SWING UNITS

BACKGROUND OF THE INVENTION

Field of Application

This invention relates to lamps; and more particularly to swing units for lamps.

BACKGROUND OF THE INVENTION

Description of the Prior Art

Wall, floor, and table lamps are in wide use to provide light in rooms, and other locations, where light fixtures and other forms of lighting have also been installed but do not provide adequate or appropriate light; and where the room design or aesthetics dictate the use of one or more lamps instead of light fixtures and/or other forms of lighting. But, a good portion of available lamps include a lamp base or stand which supports the light source in one and only one position. If light is required outside the area that light from the single position lamp falls upon, then the user must either get another lamp or move the present lamp to a new location.

Obviously wall mounted single position lamps are quite difficult to move, especially for temporary purposes. Table and floor lamps are more easily movable but only if there is the requisite table or floor space to receive the lamp. Connecting a moved single position lamp to a source of electricity may also prove bothersome because the electric cord may have to be placed across a path of movement, or furniture may be in the way, or because an electrical extension may be required where it was not needed before.

Other available lamps utilize swing arms to facilitate locating an otherwise single position lamp in many possible positions along the arc of travel of the swing arm. But, many of these swing arms have proved unacceptable because the weight of the light source (bulb, socket, shade, etc) proves to be too heavy for a single cantalevered swing arm of reasonable proportions and materials. Additionally, the available devices for holding the swing unit in place on the swing arm, so as to permit the required rotation of the unit, have sometimes been too complex in construction and expensive in cost, and other times failed to properly support the swing arm on the swing arm support unit.

Aesthetic creativity in the appearance of swing arm lamps seems to have been restricted to the light source and its shade or cover, or in the materials, colors, and shapes of the swing arms and their support units. This seems to be so because there is not too much that can be done, creatively or aesthetically, with a swing arm that is restricted to a single unit, and at that, one which must extend out in a direction perpendicular to the axis of rotation about which the lamp swings.

SUMMARY OF THE INVENTION

It is therefore an object of this invention to provide a novel and improved swing arm support unit.

It is another object of this invention to provide a novel and improved swing arm support unit for a lamp.

It is yet another object of this invention to provide a novel and improved swing arm lamp.

It is still another object of this invention to provide a novel and improved lamp swing arm support unit which mounts a pair of swing arms.

It is yet still another object of this invention to provide a novel and improved lamp swing arm support unit which mounts a pair of lamp swing arms in co-planar relationship with each other.

It is a further object of this invention to provide a novel and improved lamp swing arm support unit which mounts a pair of lamp swing arms in parallel relationship with each other.

It is still a further object of this invention to provide a novel and improved lamp swing arm support unit which provides a swing arm assembly of relatively greater strength.

It is yet still a further object of this invention to provide a novel and improved lamp swing arm support unit which enables mounting a lamp swing arm so that the lamp swing arm extends vertically, or substantially vertically, up out of the lamp swing arm support unit.

This invention involves swing arm support units for swing arm lamps: and contemplates forming the support, for the swing arm support unit, so that said support positions and retains the swing unit, (to which the swing arm is connected) in such a manner that the swing arm can be connected to either a vertically disposed wall, or a horizontally disposed wall, of the swing unit; and thus can extend out from the swing unit in directions either parallel or perpendicular to the lamp axis of rotation. Additionally, pairs of swing arms can be mounted to swing units, supported in close proximity to each other on such swing arm support units, and so as to be parallel and/or co-planar with each other and to otherwise provide creative and aesthetically pleasing appearances.

Other objects, features, and advantages of the invention in its details of construction and arrangement of parts will be seen from the above, from the following description of the preferred embodiment when considered with the drawings and from the appended claims.

BRIEF DESCRIPTION OF THE DRAWING

In the drawing:

FIG. 1 is a perspective view of a wall mounted swing arm lamp incorporating the instant invention;

FIG. 2 is an enlarged sectional elevation view of the swing arm support unit of the swing arm lamp of FIG. 1;

FIG. 3 is a perspective view of the swing unit of the swing arm support unit of FIG. 2;

FIG. 4 is a schematic perspective view of a base mounted swing arm lamp with its swing arms mounted and arranged similar to those of the wall mounted swing arm lamp of FIG. 1;

FIG. 5 is a perspective view of the swing arm support unit for the swing arm lamp of FIG. 4, cut away in part to better show details thereof;

FIG. 6 is a perspective view of a modified form of wall mounted swing arm support unit for swing arms for a swing arm lamp and which incorporates the instant invention;

FIG. 7 is a perspective view of another modified form of wall mounted swing arm support unit and swing arms, for a swing arm lamp, and which incorporates the instant invention;

FIG. 8 is a schematic perspective view of base mounted swing arm lamp with its swing arms mounted and arranged similar to those of the wall mounted swing arm lamp of FIG. 7;

FIG. 9 is a perspective view of the swing arm support unit for the swing arm lamp of FIG. 8; cut away in part to better show details thereof; and FIG. 10 is a perspective view of yet another modified form of wall mounted swing arm support unit for a single swing arm for a swing arm lamp and which incorporates the instant invention.

DESCRIPTION OF THE PREFERRED EMBODIMENT

With reference to FIG. 1, there is generally shown at 20 a swing arm lamp having a light source 22 carried at a first end 24 of an outboard swing arm 26, the second end 28 of which is connected to and extends from a swivel assembly 30. Swivel assembly 30 is otherwise carried by first ends 32, 34 of inboard swing arms 36, 38 the second ends 40, 42 of which are respectively connected to and extend from a swing arm support unit 50 adapted to be secured to a wall or other vertically disposed member (not shown). Swing arms 26, 36, and 38 are fabricated from tubular material such as pipe.

Outboard swing arm 26 has external threads (not shown) formed at its ends 24, 28; and is connected to light source 22, and swivel assembly 30, by having such external threads threaded into internal threads (not shown) formed in appropriate openings of light source 22 and swivel assembly 30. Inboard swing arms 36, 38 have external threads (not shown) formed at their respective ends 32, 40 and 34, 42; and are connected to swivel assembly 30 by having the external threads at ends 32, 34 threaded into internal threads (not shown) formed in appropriate openings of swivel assembly 30. The same procedure is followed to connect ends 40, 42 of inboard swing arms to swing arm support unit 50.

Light source 22 includes a socket 60, for receiving a suitable light bulb, and a shade 62 appropriately and conventionally mounted thereon. Suitable electrical conductor wire 64 extends from socket 60 through outboard swing arm 26, an opening (not shown) suitably formed in swivel assembly 30, through either inboard arm 36 or 38 and out through swing arm support unit 50 as will be hereinafter explained. An appropriate male plug is provided at the end of conductor 64 to connect same, and light source 22 to a source of electricity. A switch 66 is provided on socket 60 to turn same on and off, and through intermediate positions if provided. Conductor 64 can also be connected directly to a junction box, and controlled by a remote switch if desired.

Swing arm support unit 50 (FIGS. 1 and 2) includes a support bracket 70 having a centrally disposed cylindrical support tube 72 formed integral therewith. A pair of mounting openings 74, 76 (FIG. 2), formed into a back wall 78 of bracket 70, are internally threaded to receive suitable threaded members (not shown) for the purpose of mounting bracket 70, swing arm support unit 50, swing arms 36, 38 and 26 and light source 22 to a wall or other suitable vertically disposed member.

A centrally disposed opening 80 extends through bracket 70 and into an opening 81 within support tube 72 to provide a passageway for conductor 64. Two additional openings 82, 84 extend through bracket 70 and into opening 81. Openings 82, 84 are enlarged proximate back wall 78 of bracket 70 and are threaded through the remainder of their lengths to receive threaded members 86, 88 which are of a length sufficient to permit ends 90, 92 respectively of threaded member 86, 88 to extend into opening 81 for purposes to be hereinafter explained.

A pair of swing units 100 (FIGS. 2 and 3) and 102 (FIG. 2) seat upon and are supported by the respective end surfaces of support tube 72 of support bracket 70; swing unit 100 being disposed on top of cylindrical support 72, and swing unit 102 being disposed below cylindrical support 72. The outside diameter of swing units 100, 102 are substantially the same diameter as that of cylindrical support 72; however swing units 100, 102 have walls 104, 106 that are respectively thicker than wall 108 of cylindrical support 72. Ends 110, 112 of swing units 100, 102, are each formed with a diameter reduced in size when compared to that of the rest of swing units 100, 102. Circumferential circular grooves 114, 116 are respectively formed in the surfaces of reduced ends 110, 112 of swing units 100, 102. Grooves 114, 116 are disposed and sized to receive ends 90, 92 respectively of threaded members 86, 88 when threaded members 86, 88 are fully extended and after swing units 100, 102 are positioned when the swing unit mounting seats formed by the end surfaces of cylindrical support 72 (as shown in FIG. 2). Internally threaded swing arm receiving openings 120, 122 are formed respectively in swing units 100, 102 to receive threaded ends 40, 42 of swing arms 36, 38 respectively. The ends of swing units 100, 102 opposite ends 110, 112 thereof may be formed solid or if preferred openings 130, 132 with internal threads may be formed therein to receive externally threaded end caps 134, 136.

To assemble swing arm support unit 50 one need only place swing units 100, 102 with their ends 110, 112 extending respectively into opening 81 of cylindrical support 72 of bracket 70. Threaded members 86, 88 are thereafter threaded into place so that their respective ends 90, 92 extend into grooves 114, 116 respectively of swing units 100, 102.

Swing arm support unit 50 may thereafter have inboard swing arms 36, 38 threaded into swing units 100, 102 if such has not been accomplished prior to installing swing units 100, 102 on support bracket 70. In similar manner swivel assembly 30, swing arm 26 and light source 22 may thereafter be connected to swing arms 36, 38; or that may be accomplished before swing arms 36, 38 are attached to swing arm support unit 50. The fully assembled swing arm lamp 20 may thereafter be secured to a wall or other vertical support by utilizing appropriately threaded members screwed into threaded openings 74, 76 of bracket 70.

The fully assembled swing arm lamp 20 can be rotated about an axis of rotation passing through cylindrical support 72 and swing units 100, 102 because ends 90, 92 of threaded members 86, 88 will permit rotation of swing units 100, 102 but not removal thereof from swing arm support unit 50.

In FIG. 4 there is shown a swing arm support lamp 150 with a swing arm assembly 152 identical (except possibly as to size and proportions) to swing arms 36, 38, swivel 30, swing arm 26 and light source 22 of lamp 20 of FIGS. 1–3. Swing arm assembly 152 is, however, supported by a swing arm support unit 160 (FIGS. 4 and 5) secured to the upper extremity of a support post 162 (FIG. 4), which, in turn extends up from a base 164. Lamp 150 may be either positioned on a floor or upon a table, desk, dresser or the like depending upon the vertical height of support post 162 and the corresponding proportions of base 164.

Swing arm support unit 160 includes a support 170 (FIG. 5) with a first opening 172 having internal threads formed therein to receive external threads (not shown) formed on top of support post 162. A through opening 180 to receive ends 182, 184 respectively of swing units 186, 188. Swing units 186, 188 are identical to swing units 100,102 of the embodiment of FIGS. 1-3, and include threaded openings 190, 192 to receive the swing arms of swing arm assembly 150, and appropriately formed grooves to receive ends of threaded members 194, 196 to retain swing units 186, 188 in position once seated in the swing unit mounting seats formed therefore by support 170, in the manner that threaded members 86, 88 retain swing units 100, 102 on bracket 70.

In FIG. 6 there is shown a swing arm lamp 200 with a swing arm assembly 202 that has only one inboard swing arm 204 connected to and extending from a swing arm support unit 210. Swing arm support unit 210 utilizes but a single swing unit 212 disposed upon and secured to a support bracket 214. Swing unit 212 is identical to swing unit 100 (FIG. 3), and support bracket 214 provides a seat therefore and in section would appear substantially similar to support bracket 70 of FIG. 2, if cut off just below cylindrical support 72. The lower threaded member 84 would not be required for support bracket 214 but an opening for conductor wire is provided with internal threads to also facilitate attachment of bracket 214 to a wall or other support member. The lower extremity of the cylindrical support portion 216, of bracket 214 may be closed or it may be open and plugged.

In FIG. 7 there is shown a swing arm lamp 250 having a swing arm assembly 252 with a pair of inboard swing arms 254, 256 that curve outwardly and then back as then connect a swivel unit 258 to a swing arm support unit 260. The outboard arm 262 and light source 264 of lamp 250 are identical to those of lamp 20.

Swing arm support unit 260 is substantially identical to swing arm support unit 50 of lamp 20 and would appear substantially identical to the elevational section thereof, as shown in FIG. 2, except that swing units 266, 268 of swing arm support unit 260 do not have internally threaded openings such as openings 120, 122 of unit 50 formed therein; but instead have internally threaded openings formed at their respective outer ends 270, 272 to receive externally threaded ends of bowed swing arms 254, 256 respectively. Similarly swivel unit 258 has correspondingly located internally threaded openings to receive the other externally threaded ends of bowed swing arms 254, 256.

In FIG. 8 there is shown a lamp 300 with a swing arm assembly 302 identical to swing arm assembly 252 of FIG. 7. Swing arm assembly 302 is, however, connected to and carried by a swing arm support unit 304 that facilitates mounting of swing arm assembly 302 upon a support post 306 and base 308. Depending upon the size and proportions of post 306 and base 308 lamp 300 may be either disposed upon a floor or upon a table, dresser, or desk.

Swing arm support unit 304 is substantially identical to swing arm support unit 160 of FIG. 5 except that swing units 310, 312 receive the appropriate ends of swing arm assembly 302 at their exposed ends and not in a direction perpendicular to the axis of rotation thereof. As such swing units 310, 312 are identical to swing units 266, 268 of swing arm support unit of FIG. 7; while support bracket 314 of swing arm support unit 304 is identical to support 170 of FIG. 5.

In FIG. 10 there is shown a swing arm unit 350 with but a single swing arm 352 connected to and extending from a swing unit 354 carried by support 356 of swing arm support unit 358. Swing arm 352 is of bowed or arcuate configuration; while swing unit 354 is identical in construction to swing units 266, 268 of FIG. 7, and support 356 is identical in construction to support 214 of FIG. 6.

From the above description it will thus be seen that there has been provided novel and improved swing arm lamps, and novel and improved swing arm support brackets; which provide simple and efficient support for swing arm lamps with single inboard swing arms, and simple and efficient support for dual swing arms for swing arm lamps.

It is my understanding that although I have shown the preferred form of my invention that various modifications may be made in the details thereof without departing from the spirit as comprehended by the following claims.

In addition, it thus will be seen that there is provided lamp swing units which achieve the various objects of the invention, and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention.

I claim:

1. A swing arm assembly for a lamp; comprising:

(a) swing arm means for supporting a light source;

(b) swing unit means connected to said swing arm means and including a swing unit mounting portion substantially cylindrical in external configuration;

(c) support means coacting with said swing unit means to mount same for rotation about a predetermined axis of rotation;

(d) said support means including at least one swing unit mounting seat sized and arranged to receive said swing unit mounting portion and to facilitate rotation of said swing unit means about said predetermined axis of rotation;

(e) said mounting portion of said swing unit means further including a circular groove formed in its external cylindrical surface;

(f) said support means including retention means movable between a position wherein a portion of said retention means extends into said circular groove of said swing unit means and prevents movement of said swing unit means along said predetermined axis of rotation while not hindering rotation thereof about said predetermined axis of rotation, and a position removed from said circular groove to permit movement of said swing unit means in a direction along said predetermined axis of rotation;

(g) said support means further includng swing arm assembly mounting means to facilitate mounting said swing arm means.

2. The swing arm assembly of claim 1; wherein:

(a) said swing unit means includes a pair of swing units, each including a swing unit mounting portion substantially cylindrical in external configuration with a circular groove formed in the surface thereof; and (b) said support means including a pair of swing unit mounting seats spaced one from the other but aligned so that there is but one predetermined axis of rotation for both of said swing units, and a pair of said retention means one disposed for coaction with each of said circular grooves;

(c) said swing arm means includes a pair of swing arms; and (d) said swing units each being connected to one of said swing arms and mounting same in a co-planar arrangement.

3. The swing arm assembly of claim 2: wherein each of said swing units is subtantially tubular in configuration.

4. The swing arm assembly of claim 3: wherein each swing arm is substantially tubular in configuration and is connected to its respective swing unit along an axis that extends through the cylindrical tubular surface and is perpendicular to said predetermined axis of rotation.

5. The swing arm assembly of claim 2: wherein each swing arm is formed from tubular stock and into an arcuate configuration and an end of each of said swing arms is connected to its respective swing unit to be co-axial with the tubular end of the swing unit.

6. The swing arm assembly of claim 1: wherein said swing unit is substantially tubular in configuration.

7. The swing arm assembly of claim 6: wherein said swing arm is substantially tubular in configuration and is connected to said swing unit along an axis that extends through the cylindrical tubular surface and is perpendicular to said predetermined axis of rotation.

8. The swing arm assembly of claim 6: wherein said swing arm is formed from tubular stock and into an arcuate configuration and wherein a tubular end of said swing arm is connected to said swing unit so as to be co-axial therewith.

9. The swing arm assembly of claim 1: wherein said swing arm assembly mounting means of said support means comprises a substantially rectangular plate, and said swing unit mounting seat of said support means is substantially tubular in configuration extending out from said plate so that the tubular opening of said mounting seat is spaced from and extends parallel to a surface of said plate and has an axis that is co-axial with said predetermined axis of rotation.

10. The swing arm assembly of claim 9: wherein one end of said plate and one end of said tubular mounting seat terminate in a predetermined imaginary plane and said tubular mounting seat is closed at said one end.

11. The swing arm assembly of claim 9: wherein said plate extends a predetermined distance beyond each end of said tubular mounting seat and said mounting seat mounts a swing unit at each of its ends.

12. The swing arm assembly of claim 1: wherein said swing arm assembly mounting means is plate like in configuration and facilitates mounting the swing arm assembly to a wall or flat surface.

13. The swing arm assembly of claim 1: wherein said swing arm assembly mounting means is substantially tubular in configuration and serves to mount the swing arm assembly on top of a tubular support.

14. A swing arm support unit for a swing arm lamp; comprising:

(a) swing unit means to be connected to the swing arm means for a swing arm lamp and including a swing unit mounting portion substantially cylindrical in external configuration;

(b) support means coacting with said swing unit means to mount same for rotation about a predetermined axis of rotation;

(c) said support means including at least one swing unit mounting seat sized and arranged to receive said swing unit mounting portion and to facilitate rotation of said swing unit means about said predetermined axis of rotation;

(d) said mounting portion of said swing unit means further including a circular groove formed in its external cylindrical surface;

(e) said support means including retention means movable between a position wherein a portion of said retention means extends into said circular groove of said swing unit means and prevents movement of said swing unit means along said predetermined axis of rotation while not hindering rotation thereof about said predetermined axis of rotation, and a position removed from said circular groove to permit movement of said swing unit means in a direction along said predetermined axis of rotation;

(f) said support means further including support unit mounting means to facilitate mounting said support unit.

15. The swing arm support unit of claim 14; wherein:

(a) said swing unit means includes a pair of swing units, each including a swing unit mounting portion substantially cylindrical in external configuration with a circular groove formed in the surface thereof; and (b) said support means including a pair of swing unit mounting seats spaced one from the other but aligned so that there is but one predetermined axis of rotation for both of said swing units, and a pair of said retention means one disposed for coaction with each of said circular grooves.

16. The swing arm support unit of claim 15: wherein each of said swing units is substantially tubular in configuration.

17. The swing arm support unit of claim 14: wherein said support unit mounting means comprises a substantially rectangular plate, and said swing unit mounting seat of said support means is substantially tubular in configuration extending out from said plate so that the tubular opening of said mounting seat is spaced from and extends parallel to a surface of said plate and has an axis that is co-axial with said predetermined axis of rotation.

18. The swing arm support unit of claim 17: wherein one end of said plate and one end of said tubular mounting seat terminate in a predetermined imaginary plane and said tubular mounting seat is closed at said one end.

19. The swing arm support unit of claim 17: wherein said plate extends a predetermined distance beyond each end of said tubular mounting seat and said mounting seat mounts a swing unit at each of its ends.

20. The swing arm support unit of claim 14: wherein said support unit mounting means is plate like in configuration and facilitates mounting a swing arm assembly to a wall or flat surface.

21. The swing arm support unit of claim 14: wherein said support unit mounting means is substantially tubular in configuration and serves to mount a swing arm assembly on top of a tubular support.

* * * * *